US009494014B1

(12) United States Patent
Manke et al.

(10) Patent No.: US 9,494,014 B1
(45) Date of Patent: Nov. 15, 2016

(54) MULTI-CYCLE CIRCULATING VALVE ASSEMBLY

(71) Applicant: THRU TUBING SOLUTIONS, INC., Oklahoma, OK (US)

(72) Inventors: Kevin R. Manke, Blanchard, OK (US); Roger L. Schultz, Newcastle, OK (US)

(73) Assignee: Thru Tubing Solutions, Inc., Oklahoma City, OK (US)

( * ) Notice: Subject to any disclaimer, the term of this patent is extended or adjusted under 35 U.S.C. 154(b) by 0 days.

(21) Appl. No.: 15/057,698

(22) Filed: Mar. 1, 2016

(30) Foreign Application Priority Data

May 6, 2015 (WO) ..... PCT/US2015/029399

(51) Int. Cl.

| | |
|---|---|
| ***E21B 34/10*** | (2006.01) |
| ***E21B 28/00*** | (2006.01) |
| ***E21B 43/11*** | (2006.01) |
| ***E21B 43/114*** | (2006.01) |

(52) U.S. Cl.
CPC ..... *E21B 34/10* (2013.01); *E21B 28/00* (2013.01); *E21B 43/114* (2013.01)

(58) Field of Classification Search
CPC ..... E21B 34/10; E21B 43/114; E21B 28/00; E21B 34/06
USPC ..... 166/334.4, 331, 373, 374
See application file for complete search history.

(56) References Cited

U.S. PATENT DOCUMENTS

| | | | | |
|---|---|---|---|---|
| 2,034,768 A | | 3/1936 | O'Neill | |
| 4,804,044 A | * | 2/1989 | Wesson | E21B 23/006 166/297 |
| 5,335,731 A | * | 8/1994 | Ringgenberg | E21B 23/006 166/264 |

(Continued)

FOREIGN PATENT DOCUMENTS

| | | |
|---|---|---|
| WO | 2007055888 A1 | 5/2007 |
| WO | 2016068882 A1 | 5/2016 |

OTHER PUBLICATIONS

International Search Report with Written Opinion issued Jan. 25, 2016 for PCT Patent Appllication No. PCT/US15/029399, 19 pages.

(Continued)

*Primary Examiner* — Michael Wills, III
(74) *Attorney, Agent, or Firm* — Smith IP Services, P.C.

(57) ABSTRACT

A circulating valve assembly can include a valve controlling flow between an interior and an exterior of the assembly, another valve controlling flow between sections of a flow passage extending through the assembly, and an actuator that both opens one valve and closes the other valve in response to each of multiple positive pressure differentials from the interior to the exterior. A system for use with a well can include a circulating valve assembly controlling flow through a tubular string and a well tool connected in the tubular string downstream of the assembly. In one configuration of the assembly, the flow passes through the well tool. In another configuration, the flow passes from the tubular string to an annulus external to the tubular string, with the flow substantially bypassing the well tool. The assembly cycles between the configurations in response to alternating increases and decreases in the flow.

26 Claims, 18 Drawing Sheets

(56) References Cited

U.S. PATENT DOCUMENTS

| | | | | |
|---|---|---|---|---|
| 5,529,126 | A * | 6/1996 | Edwards | E21B 34/108 166/240 |
| 5,890,542 | A * | 4/1999 | Ringgenberg | E21B 21/10 166/321 |
| 5,984,014 | A * | 11/1999 | Poullard | E21B 34/10 166/324 |
| 6,109,354 | A | 8/2000 | Ringgenberg et al. | |
| 6,659,186 | B2 * | 12/2003 | Patel | E21B 23/006 166/332.2 |
| 8,490,702 | B2 | 7/2013 | Stromquist et al. | |
| 9,115,558 | B2 | 8/2015 | Stang | |
| 2004/0129423 | A1 * | 7/2004 | Eddison | E21B 21/103 166/321 |
| 2004/0345707 | | 7/2004 | Eddison | |
| 2008/0142219 | A1 | 6/2008 | Steele et al. | |
| 2009/0166044 | A1 | 7/2009 | Branch et al. | |
| 2009/0250224 | A1 * | 10/2009 | Wright | E21B 23/04 166/373 |
| 2011/0061938 | A1 * | 3/2011 | Miszewski | E21B 7/067 175/73 |
| 2012/0205108 | A1 * | 8/2012 | Stang | E21B 43/114 166/298 |
| 2013/0112426 | A1 | 5/2013 | Frosell | |
| 2014/0345705 | A1 * | 11/2014 | Grande | E21B 23/006 137/68.17 |
| 2015/0354307 | A1 * | 12/2015 | Baudoin | E21B 28/00 166/373 |

OTHER PUBLICATIONS

Thrutubing Solutions; "Circulating Sub", company website catalog via www.thrutubing.com, dated 2013, 8 pages.

Bico Drilling Tools; "PBL multiple Activation Autolock Bypass System", company brochure, received Apr. 7, 2015, 2 pages.

Mi Swaco; "Well Commander", company brochure, dated Jul. 2014, 8 pages.

* cited by examiner

MULTI-CYCLE CIRCULATING VALVE ASSEMBLY

CROSS-REFERENCE TO RELATED APPLICATION

The present application claims the benefit under 35 USC §119 of the filing date of International Application No. PCT/US15/29399, filed 6 May 2015. The entire disclosure of this prior application is incorporated herein by this reference.

BACKGROUND

This disclosure relates generally to equipment utilized and operations performed in conjunction with a subterranean well and, in one example described below, more particularly provides a circulating valve assembly that can be repeatedly cycled between different configurations.

It can be beneficial to be able to control how fluid flows through a tubular string in a well. For example, it may be desirable to be able to flow fluid through a section of the tubular string in some circumstances, and to prevent the flow of fluid through the tubular string section in other circumstances. As another example, it may be desirable to be able to selectively permit and prevent flow through a sidewall of the tubular string. Therefore, it will be readily appreciated that improvements are continually needed in the art of controlling fluid flow in wells.

DETAILED DESCRIPTION

Figure 1:
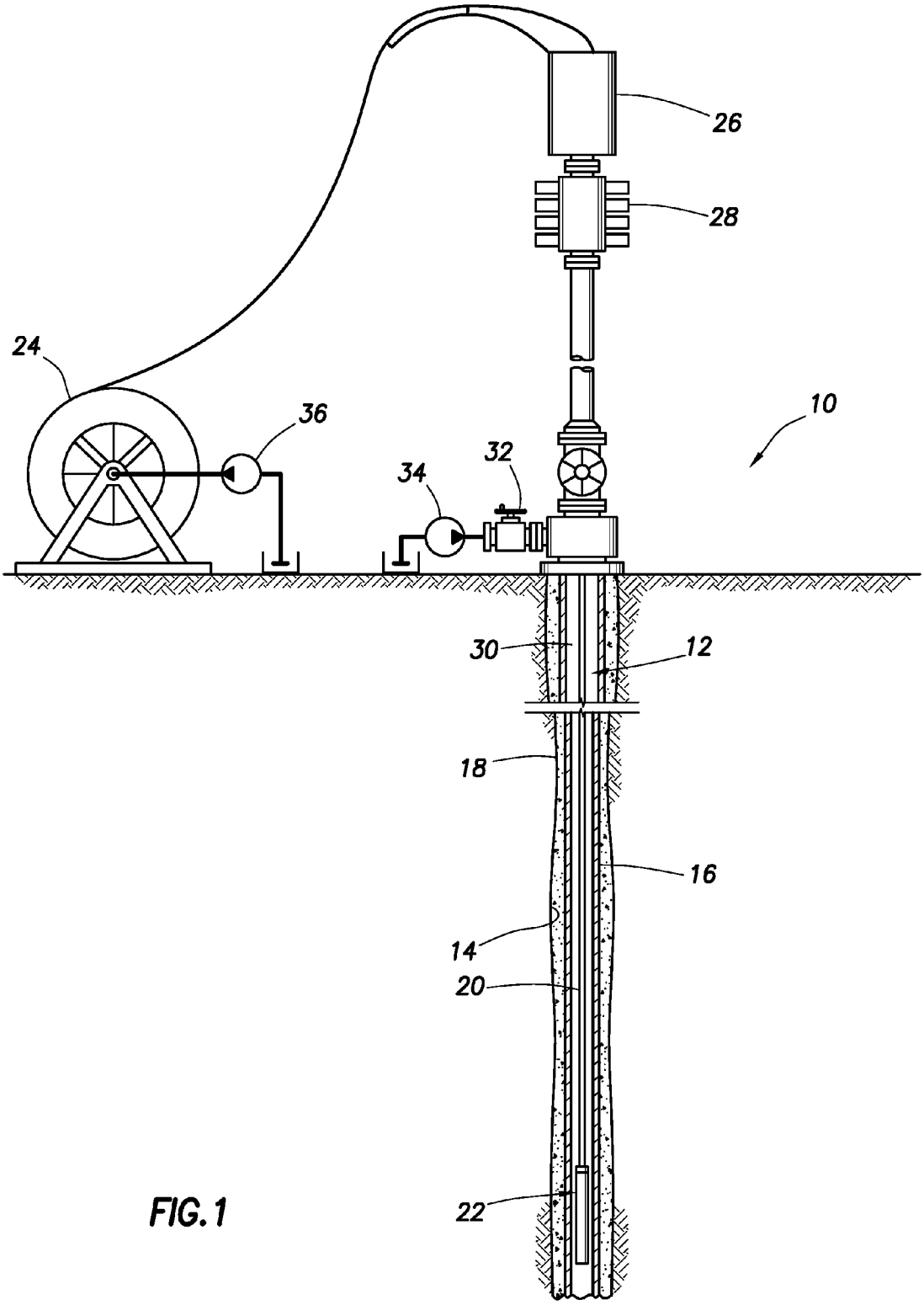
FIG. 1 is a representative partially cross-sectional view of an example of a well system and associated method which can embody principles of this disclosure.

Representatively illustrated in FIG. 1 is a system 10 for use with a well, and an associated method, which can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is conveyed into a wellbore 14 lined with casing 16 and cement 18. Although multiple casing strings would typically be used in actual practice, for clarity of illustration only one casing string 16 is depicted in the drawings.

Although the wellbore 14 is illustrated as being vertical, sections of the wellbore could instead be horizontal or otherwise inclined relative to vertical. Although the wellbore 14 is completely cased and cemented as depicted in FIG. 1, any sections of the wellbore in which operations described in more detail below are performed could be uncased or open hole. Thus, the scope of this disclosure is not limited to any particular details of the system 10 and method.

The tubular string 12 of FIG. 1 comprises coiled tubing 20 and a bottom hole assembly 22. As used herein, the term "coiled tubing" refers to a substantially continuous tubing that is stored on a spool or reel 24. The reel 24 could be mounted, for example, on a skid, a trailer, a floating vessel, a vehicle, etc., for transport to a wellsite.

Although not shown in FIG. 1, a control room or cab would typically be provided with instrumentation, computers, controllers, recorders, etc., for controlling equipment such as an injector 26 and a blowout preventer stack 28. Note that it is not necessary for coiled tubing to be used in the tubular string 12. In other examples, the tubular string 12 could comprise jointed pipe.

As used herein, the term "bottom hole assembly" refers to an assembly connected at a distal end of a tubular string in a well. It is not necessary for a bottom hole assembly to be positioned or used at a "bottom" of a hole or well.

When the tubular string 12 is positioned in the wellbore 14, an annulus 30 is formed radially between them. Fluid, slurries, etc., can be flowed from surface into the annulus 30 via, for example, a casing valve 32. One or more pumps 34 may be used for this purpose. Fluid can also be flowed to surface from the wellbore 14 via the annulus 30 and valve 32.

Fluid, slurries, etc., can also be flowed from surface into the wellbore 14 via the tubing 20, for example, using one or more pumps 36. Fluid can also be flowed to surface from the wellbore 14 via the tubing 20.

In the FIG. 1 system 10 and method, it is desired in some circumstances to flow fluid through the tubular string 12, so that the fluid exits the distal end of the tubular string, passing through all, or substantially all, of the bottom hole assembly 22. In other circumstances, it is desired to flow fluid through the tubular string 12, so that the fluid does not exit the distal end of the tubular string, but instead exits the bottom hole assembly 22 and passes into the annulus 30 above (closer to a surface of the well) the distal end of the tubular string. In these latter circumstances, the fluid bypasses (does not flow through) a portion of the bottom hole assembly 22.

Figure 2:
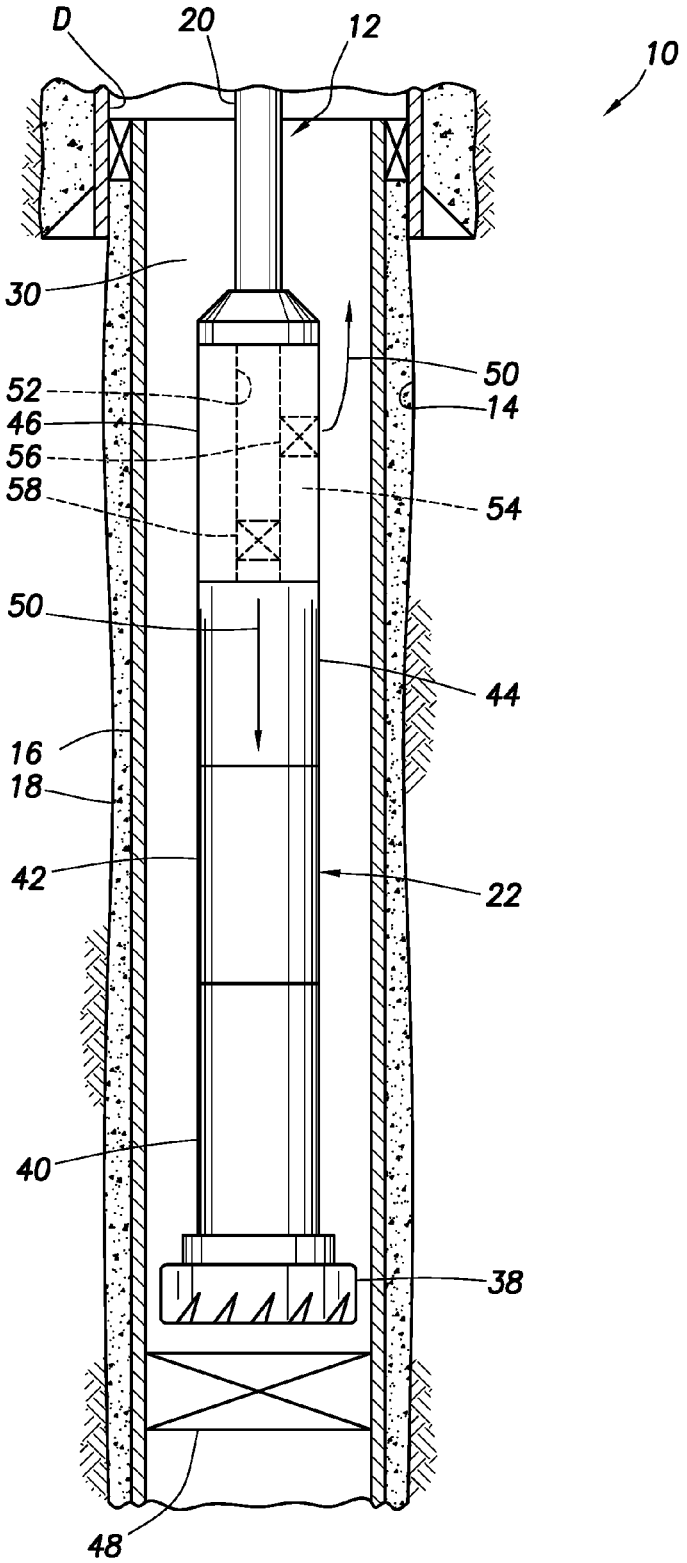
FIG. 2 is an enlarged scale representative partially cross-sectional view of an example of a bottom hole assembly that may be used in the system and method of FIG. 1.

Referring additionally now to FIG. 2, an example of the bottom hole assembly 22 that may be used in the system 10 and method of FIG. 1 is representatively illustrated. The bottom hole assembly 22 may be used in other systems and methods, in keeping with the principles of this disclosure.

In the FIG. 2 example, the bottom hole assembly 22 includes a bit 38, a fluid motor 40, a drill collar and/or drilling stabilizer 42, a vibratory tool 44 and a circulating valve assembly 46. The bit 38 in this example may be a drill bit or a milling bit, and may be used to drill or mill through a plug 48 in liner or casing 16. In other examples, the bit 38 may be used to drill the wellbore 14 further, the bit may instead be a washover tool, an underreamer or any other type of cutting tool.

The fluid motor 40 may be a drilling motor, a Moineau-type positive displacement motor, a turbine motor or any other type of fluid motor. A suitable motor for use in the bottom hole assembly 22 is the TITAN™ motor marketed by Thru Tubing Solutions, Inc. of Oklahoma City, Okla. USA.

The stabilizer 42 may include a centralizer, an anti-rotation device (for preventing rotation relative to the wellbore 14 or casing 16), one or more weight bars or collars, etc.

The vibratory tool 44 is used to generate vibration in the bottom hole assembly 22, in order to allow the bottom hole assembly to more readily displace along the casing 16 (for example, if the wellbore 14 is horizontal or substantially inclined), or to prevent differential sticking if the bottom hole assembly is used in an uncased or open hole portion of the wellbore. A suitable vibratory tool for use in the bottom hole assembly 22 are the ACHIEVER™ and XRV™ vibratory tools marketed by Thru Tubing Solutions, Inc.

The circulating valve assembly 46 is used in this example to control flow of fluid 50 through the bottom hole assembly 22. In one configuration, the circulating valve assembly 46 directs the fluid 50 to flow from the tubing 20, completely through a flow passage 52 formed longitudinally through the circulating valve assembly, and through a remainder of the bottom hole assembly 22, so that the fluid exits the bit 38 at a distal end of the tubular string 12.

Flow of the fluid 50 through the bottom hole assembly 22 causes the vibratory tool 44 to induce vibrations in the bottom hole assembly, and causes the fluid motor 40 to rotate the bit 38. In this manner, the bottom hole assembly 22 can be used to drill or mill through the plug 48.

In this first configuration, the fluid 50 is prevented by the circulating valve assembly 46 from flowing directly from the flow passage 52 and into the annulus 30 through a sidewall 54 of the circulating valve assembly. Thus, all of the fluid 50 is directed by the circulating valve assembly 46 to flow through the other well tools (the bit 38, fluid motor 40, stabilizer 42 and vibratory tool 44) connected downstream of the circulating valve assembly in the bottom hole assembly 22.

In another configuration, the circulating valve assembly 46 can permit the fluid 50 to flow directly from the flow passage 52 and into the annulus 30 through the sidewall 54 of the circulating valve assembly, and prevent the fluid from flowing to the other well tools (the bit 38, fluid motor 40, stabilizer 42 and vibratory tool 44) connected downstream of the circulating valve assembly in the bottom hole assembly 22. Thus, in this second configuration, all of the fluid 50 is directed by the circulating valve assembly 46 to flow into the annulus 30 and bypass the other well tools connected downstream of the circulating valve assembly in the bottom hole assembly 22.

The circulating valve assembly 46 includes two valves 56, 58 for controlling flow through the sidewall 54 and the flow passage 52, respectively. In the first configuration described above, the first valve 56 is closed and the second valve 58 is open. In the second configuration described above, the first valve 56 is open and the second valve 58 is closed.

The circulating valve assembly 46 can be cycled between the first and second configurations repeatedly by alternately increasing and decreasing flow through the passage 52 to thereby produce corresponding positive pressure differentials from the flow passage 52 to the annulus 30.

For example, when deployed into the well, the circulating valve assembly 46 may be in the first configuration, allowing the fluid 50 to flow through the bit 38, fluid motor 40 and vibratory tool 44, so that the plug 48 can be drilled through, the wellbore 14 can be drilled further, etc. The bit 38, fluid motor 40 and vibratory tool 44 restrict the flow of the fluid 50, and so a positive pressure differential is produced from the passage 52 to the annulus 30 at the circulating valve assembly 46.

If it is desired to cease rotation of the bit 38 and circulate the fluid 50 out of the tubular string 12 via the sidewall 54 of the circulating valve assembly 46, the flow of the fluid can be decreased, and then increased, to thereby place the circulating valve assembly in the second configuration. Such a situation may occur if, for example, it is desired to increase a velocity of the fluid 50 in the annulus 30, in order to flush cuttings from the annulus.

If a gas such as nitrogen is used in the fluid 50, it may be desired to prevent the gas from passing through the fluid motor 40 at increased flow rates needed to achieve appropriate fluid velocity in the annulus 30 (such as, in an increased casing diameter D), in order to prevent the fluid motor from exceeding a safe operating speed. Furthermore, at an increased flow rate (whether or not a gas is used in the fluid 50), an unacceptably large pressure differential across the tubing 20 could be created if the fluid is forced to flow through the restrictions of the bit 38, fluid motor 40 and vibratory tool 44. However, it should be clearly understood that the scope of this disclosure is not limited to any particular purpose for operating the circulating valve assembly 46 between its first and second configurations.

In some situations, it may be desired to allow some flow through the valve 58 in the second configuration. For example, it may be desired for there to be a minimal amount of fluid motor 40 rotation and/or it may be desired for some fluid 50 to flow out of the distal end of the tubular string 12 (e.g., to prevent differential sticking, to circulate fluid through the annulus 30, to provide for mud pulse telemetry, etc.).

Thus, in the closed position of the valve 58, some flow of the fluid 50 may be permitted. The terms "close," "closed," "closes," and similar terms as used herein are, therefore, used to indicate a substantially increased restriction to flow (as compared to an open position), without requiring a complete absence of flow.

Figure 3A:
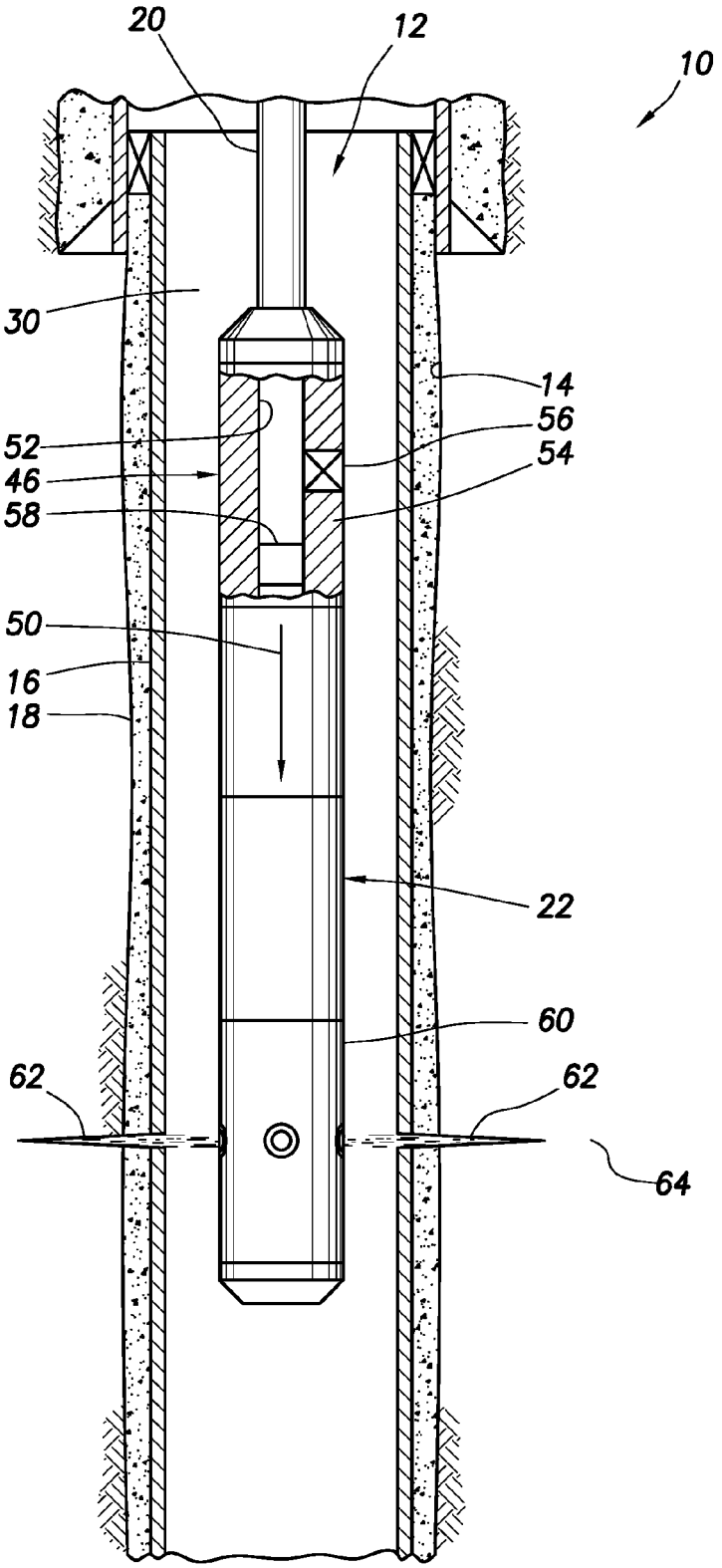
FIGS. 3A & B are representative partially cross-sectional views of another example of a bottom hole assembly that may be used in the system and method of FIG. 1, the bottom hole assembly being depicted during perforating and plugging operations.

Referring additionally now to FIGS. 3A & B, another example of the bottom hole assembly 22 and a method of using the bottom hole assembly in the well is representatively illustrated. In this example, the bottom hole assembly 22 includes the circulating valve assembly 46 and an abrasive jet perforator 60. Other well tools may be used in the bottom hole assembly 22 in keeping with the principles of this disclosure.

As depicted in FIG. 3A, the perforator 60 is used to form perforations 62 through the casing 16 and cement 18, and into an earth formation zone 64. The perforations 62 provide for fluid communication between the zone 64 and an interior of the casing 16.

The circulating valve assembly 46 is in its first configuration for the perforating step of the FIGS. 3A & B method. Thus, the fluid 50 (typically along with an abrasive in slurry form) is permitted to flow through the passage 52 via the open valve 58 to the perforator 60 to form the perforations 62. The fluid 50 is prevented from flowing to the annulus 30 via the closed valve 56.

Figure 3B:
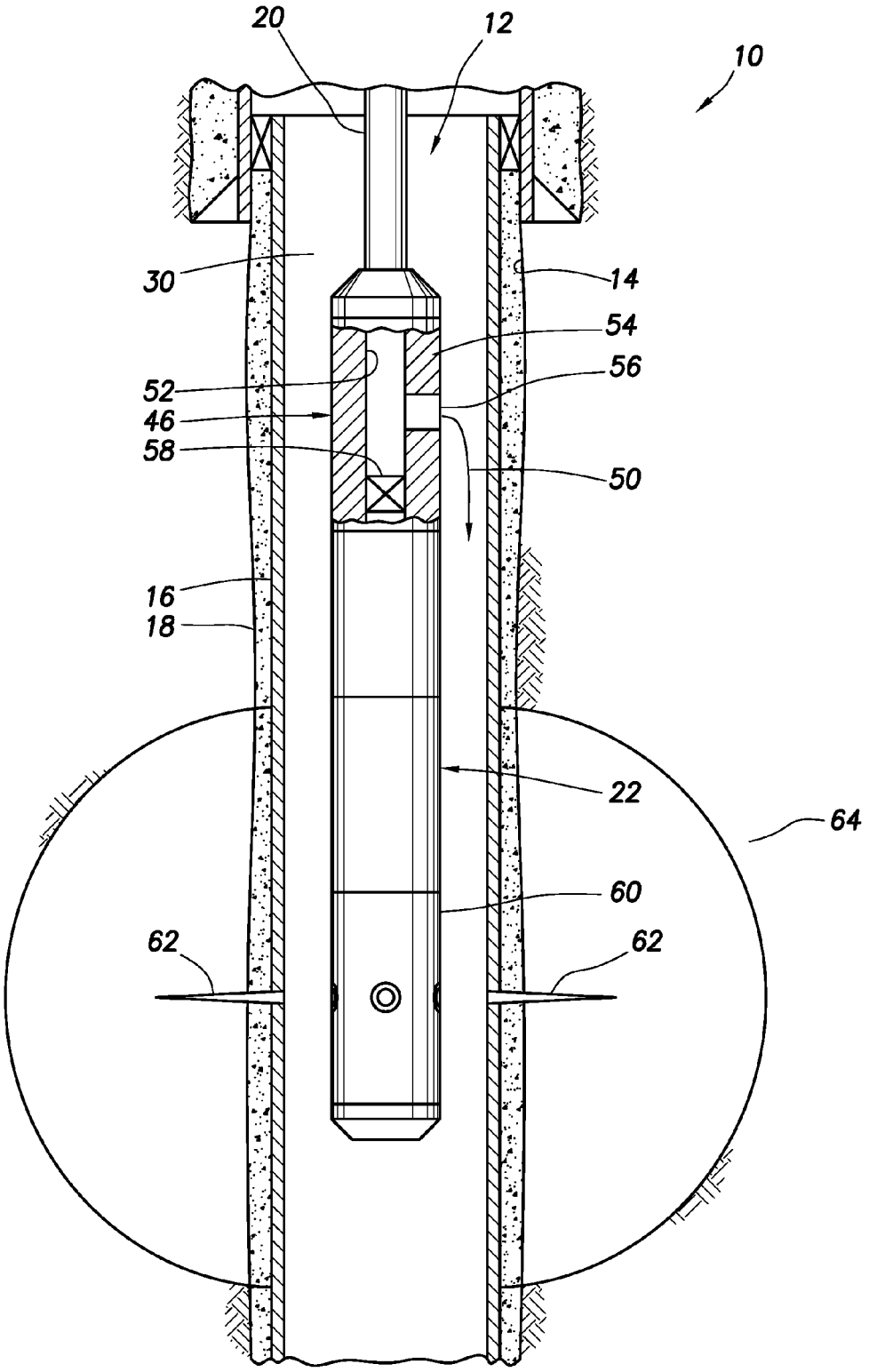

Referring additionally now to FIG. 3B, the system 10 and method are representatively illustrated after the zone 64 has been fractured. To fracture the zone 64, increased pressure is applied to the zone via the perforations 62. The increased pressure may be applied via the annulus 30 (e.g., by use of the pump 34 of FIG. 1) or via the tubular string 12 (e.g., by use of the pump 36 of FIG. 1).

As depicted in FIG. 3B, the circulating valve assembly 46 is in its second configuration. In this configuration, the valve 56 is open to permit the fluid 50 to flow from the passage 52 to the annulus 30 through the sidewall 54 of the circulating valve assembly 46. Thus, the fluid 50 can be used for the fracturing operation, without the fluid (which may include a proppant in slurry form) passing through the perforator 60.

Even if the fluid 50 is not used for the fracturing operation, it may be used to convey a plugging or diverting agent to seal off the perforations 62 and/or fractured zone 64, in order to prevent pressure from being applied from the casing 16 to the zone. Such plugging could be desired if, for example, it is planned to perforate and fracture another zone. With the circulating valve assembly 46 in its second configuration, the fluid 50 with the plugging or diverting agent is prevented from flowing through the perforator 60 (which might otherwise cause plugging of the perforator).

The circulating valve assembly 46 can be repeatedly cycled between its first and second configurations, in order to be appropriately configured for multiple perforating and fracturing and/or plugging operations in the method of FIGS. 3A & B. As described above for the FIG. 2 method, the circulating valve assembly 46 can be cycled between its first and second configurations by alternately increasing and decreasing flow through the passage 52.

Figure 4:
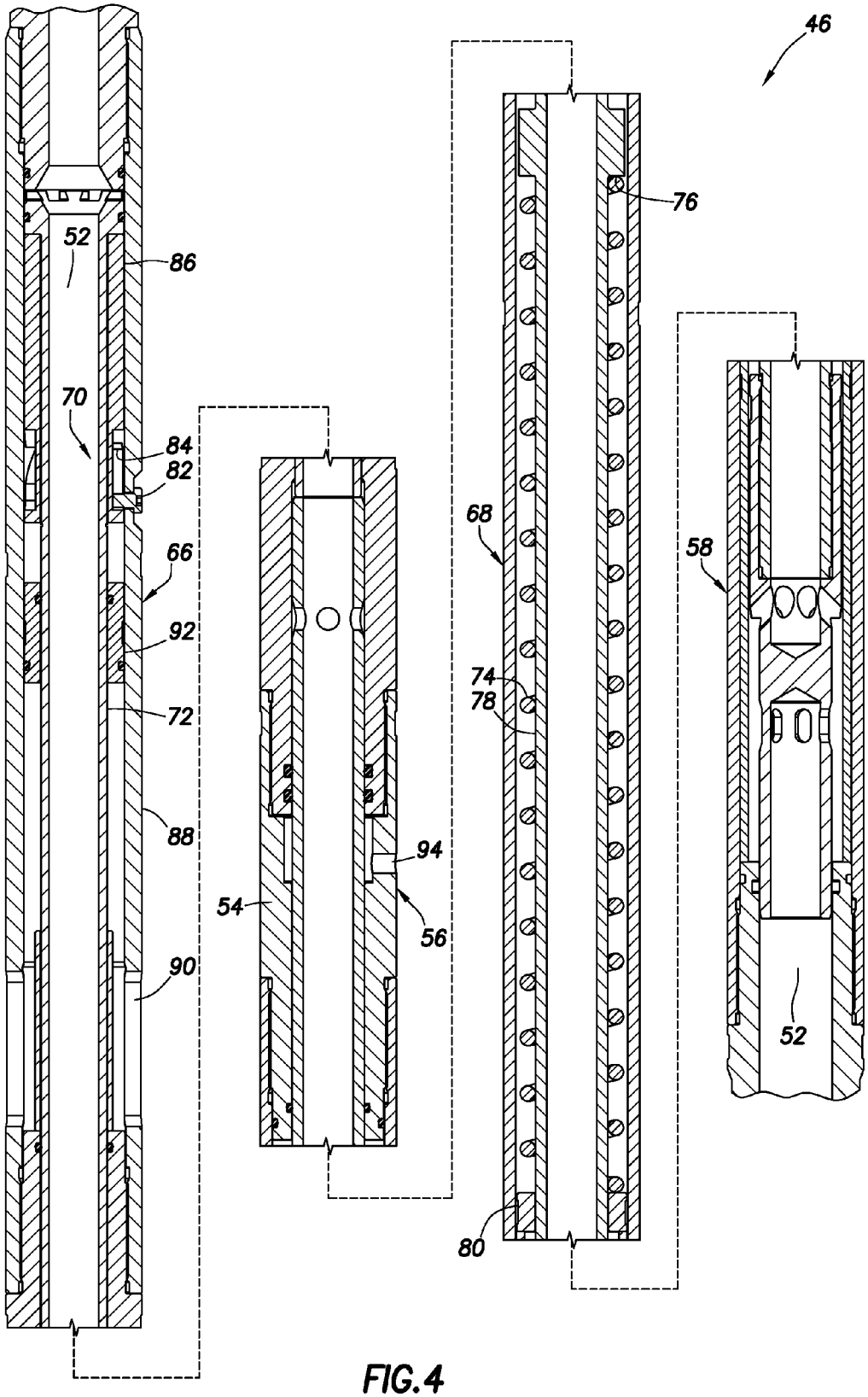
FIG. 4 is an enlarged scale representative cross-sectional view of a circulating valve assembly that may be used in the bottom hole assemblies of FIGS. 1-3B, and which can embody the principles of this disclosure.

Referring additionally now to FIG. 4, a more detailed cross-sectional view of an example of the circulating valve assembly 46 is representatively illustrated. The circulating valve assembly 46 is depicted in four contiguous sections, each of which is described in more detail below.

In the FIG. 4 example, the circulating valve assembly 46 includes an actuator 66, the valve 56, a biasing device 68 and the valve 58. The actuator 66 is used to operate the first and second valves 56, 58. The biasing device 68 is used to provide a biasing force to the actuator 66 in opposition to a force produced by a positive pressure differential from an interior to an exterior of the assembly 46. In other examples, the biasing device 68 could be incorporated into the actuator 66, or otherwise could be considered as a component of the actuator.

The biasing device 68 in this example includes a coiled compression spring 74 that exerts the biasing force against a radially enlarged shoulder 76 formed on a generally tubular inner mandrel 78. A level of the biasing force can be adjusted by varying a length of a spacer 80. In other examples, the spring 74 could be replaced by an extension spring, a pressurized gas chamber, a compressible solid or liquid, etc.

The actuator 66 includes a ratchet device 70 coupled to an inner generally tubular mandrel 72. The ratchet device 70 controls longitudinal displacement of the mandrel 72 in response to the biasing force exerted by the biasing device 68 and the force produced by the positive pressure differential from an interior to an exterior of the assembly 46. The actuator mandrel 72 abuts the biasing device mandrel 78, with the biasing force exerted by the biasing device 68 maintaining contact between the mandrels.

Figure 5:
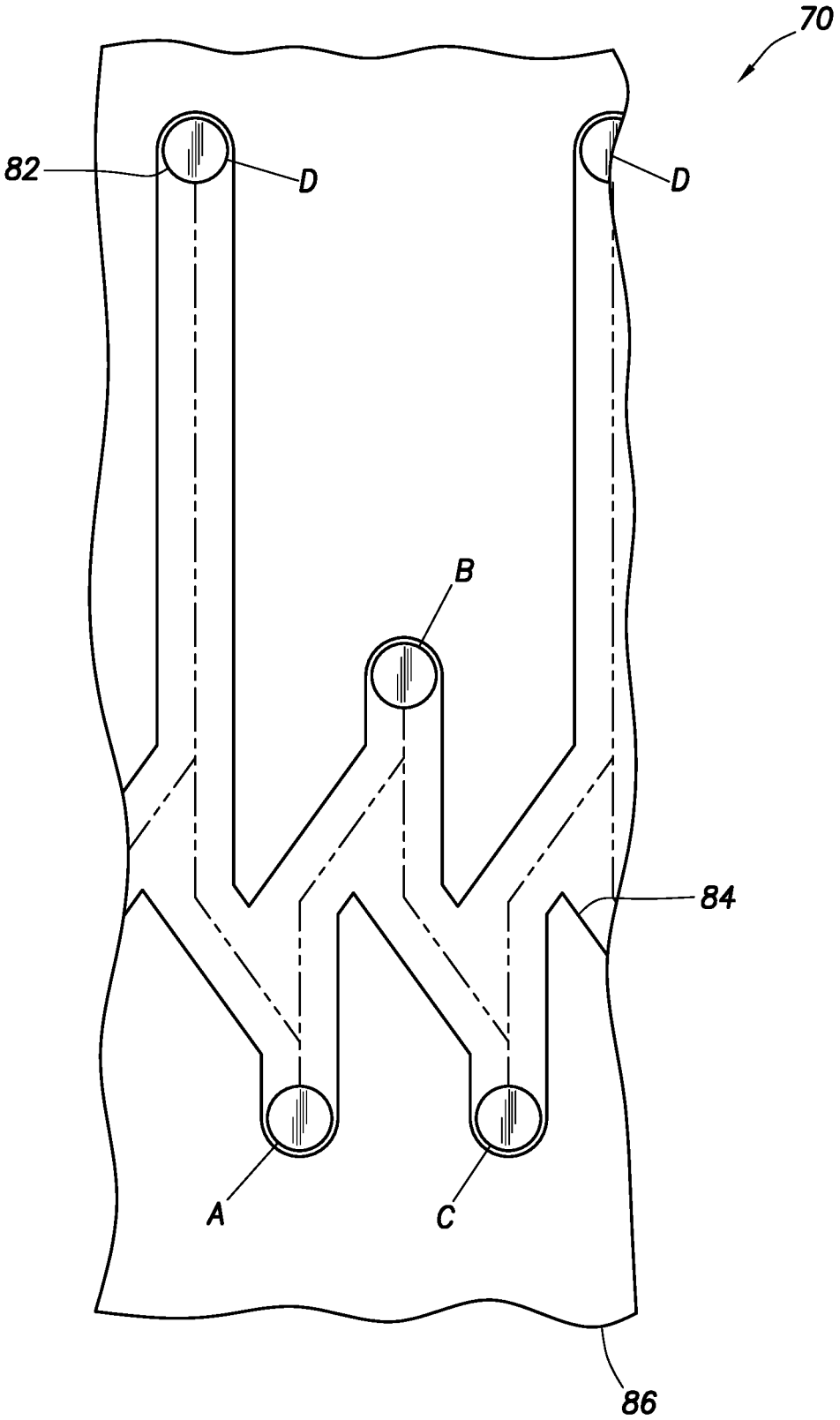
FIG. 5 is an enlarged scale representative side view of a portion of an actuator ratchet device of the circulating valve assembly.

Referring additionally now to FIG. 5, an enlarged scale view of a portion of the ratchet device 70 is representatively illustrated. In this view, it may be seen that the ratchet device 70 includes a follower 82 (such as, a pin or lug) engaged with a profile 84 formed on a sleeve 86.

The sleeve 86 is rotatably coupled to the actuator mandrel 72, and the follower 82 is fastened to an outer housing 88 of the actuator 66. Thus, displacement of the actuator mandrel 72 relative to the outer housing 88 is controlled by the engagement between the follower 82 and the profile 84.

Note that, in other examples, the follower 82 could be formed on or coupled to the actuator mandrel 72, and the profile 84 could be formed in or coupled to the outer housing 88. Therefore, it should be appreciated that the scope of this disclosure is not limited to any particular construction, arrangement or details of the circulating valve assembly 46 or components thereof.

In the FIG. 5 example, the profile 84 is of the type well known to those skilled in the art as a "J-slot" profile, since segments thereof have a "J" shape. However, other types of profiles may be used in keeping with the principles of this disclosure.

The sleeve 86 has various positions relative to the follower 82, designated as positions A-D in FIG. 5. Note that it is the sleeve 86 and actuator mandrel 72 that displace relative to the follower 82 in this example, and that multiple sets of the positions A-D may be provided by appropriate configuration of the profile 84 on the sleeve 86.

Position A corresponds to an initial run-in arrangement of the sleeve 86 and actuator mandrel 72, with the biasing device 68 urging the actuator mandrel upward (as viewed in the drawings) relative to the follower 82 and outer housing 88. This is the first configuration of the circulating valve assembly 46, with the first valve 56 closed and the second valve 58 open.

Position B corresponds to an arrangement in which fluid 50 is flowing through the passage 52 at a flow rate sufficient to produce a positive pressure differential from the interior to the exterior of the circulating valve assembly 46, with the pressure differential causing a downwardly directed force to be exerted on the actuator mandrel 72.

The force due to the pressure differential is exerted on the actuator mandrel 72 due to an interior of the mandrel being exposed to pressure in the flow passage 52, and an exterior of the mandrel being exposed to pressure on the exterior of the circulating valve assembly 46 (e.g., in the annulus 30, see FIG. 1-3B). The exterior pressure is communicated to the actuator mandrel 72 by means of a port 90 in the outer housing 88 and a floating piston 92 that maintains a clean fluid (such as hydraulic oil) in the ratchet device 70.

The pressure differential is produced due to the flow of the fluid 50 through a restriction at, or downstream of, the circulating valve assembly 46. For example, with the valve 58 open, the fluid 50 will flow through the valve itself, and the bit 38, fluid motor 40, stabilizer 42 and vibratory tool 44 of the FIG. 2 bottom hole assembly 22, or the perforator 60 of the FIGS. 3A & B bottom hole assembly. Each of these can present a restriction to flow of the fluid 50.

Position C of the FIG. 5 ratchet device 70 corresponds to a decrease in the rate of flow of the fluid 50 through the passage 52, with a resulting decrease in the pressure differential across the actuator mandrel 72. The biasing device 68, thus, displaces the actuator mandrel 72 and sleeve 86 upward, so that the follower 82 advances to the C position in the profile 84.

Position D corresponds to another increase in the rate of flow of the fluid through the passage 52, with a resulting increase in the pressure differential across the actuator mandrel 72. Due to the increased pressure differential, the force exerted on the actuator mandrel 72 by the pressure differential overcomes the biasing force exerted by the biasing device 68, and the actuator mandrel and sleeve 86 displace downward, so that the follower 82 advances to the D position in the profile 84.

In this configuration (with the follower 82 in the D position), the mandrels 72, 78 are displaced sufficiently downward to close the valve 58 and open the valve 56. Thus, the fluid 50 can no longer flow to a section of the flow passage 52 below the valve 58, but can flow outward through a port 94 of the valve 56.

The port 94 can be angled or inclined relative to a longitudinal axis of the circulating valve assembly 46, for example, in order to direct flow from the port upwardly or downwardly in the annulus 30. In some examples, the port 94 could be angled upward (toward the surface) about 45 degrees for cuttings removal during drilling, and/or could be angled downward about 45 degrees for delivery of a diverting substance in a fracturing operation.

In the FIG. 4 example, the port 94 is dimensioned so that it presents less of a restriction to flow of the fluid 50 as compared to the combined valve 58 and any well tools in communication with the flow passage 52 downstream of the valve 58. In this case, it is expected that the pressure differential from the interior to the exterior of the circulating valve assembly 46 will decrease when the valve 56 opens, and this pressure differential decrease can be used as an indication of the circulating valve assembly's successful change from its first to its second configuration.

Although the pressure differential decreases, in this example, when the circulating valve assembly 46 assumes its second configuration, the port 94 is appropriately dimensioned so that, at an expected range of desired circulating flow rates through the port, the pressure differential will still be great enough to maintain the circulating valve assembly in the second configuration. That is, a restriction to flow through the port 94 is less than that of the combined valve 58 and any well tools in communication with the flow passage 52 downstream of the valve 58 in the first configuration, but the restriction to flow through the port is great enough to maintain the valve 56 open in the second configuration.

In some circumstances, such a reduced restriction to flow with the valve 56 open is desirable (for example, when it is desired to prevent excessive rotational speed of the fluid motor 40, when it is desired to increase flow velocity in the annulus 30 without over-pressuring the coiled tubing 20, when it is desired to permit an increased flow rate of a fluid or slurry into the well, etc.). However, the scope of this disclosure is not limited to the circulating valve assembly 46 having a reduced restriction to flow, or a decreased pressure differential, in its second configuration at a given flow rate. Instead, the circulating valve assembly 46 could in some examples have an increased or unchanged restriction to flow, or an increased or unchanged pressure differential, in its second configuration at a given flow rate.

The circulating valve assembly 46 example of FIGS. 4 & 5 remains in the second configuration (with the valve 56 open and the valve 58 closed) as long as the flow rate is sufficient to maintain a pressure differential from the interior to the exterior of the circulating valve assembly great enough to overcome the biasing force exerted by the biasing device 68. When sufficient flow rate is not maintained, the pressure differential decreases to a level at which the biasing force exerted by the biasing device 68 can displace the mandrels 72, 78 upward, so that the follower 82 is again at the A position in the profile 84.

Note that the profile 84 may have multiple sets of the A-D positions, so that the follower 82 does not necessarily return to the same A position after each cycling of the circulating valve assembly 46 between its first and second configurations. However, since the profile 84 is continuous about the sleeve 86, the follower 82 could engage a same set of the A-D positions multiple times.

In the FIG. 5 ratchet device 70 example, the circulating valve assembly 46 is in its first configuration when the follower 82 is at the A-C positions, and the circulating valve assembly is in its second configuration when the follower is at the D position. Thus, the circulating valve assembly 46 is in its first configuration initially (position A), and remains in its first configuration during a subsequent flow increase (position B) and a subsequent flow decrease (position C), and then changes to its second configuration in response to another flow increase (position D). The circulating valve assembly 46 then changes back to its first configuration in response to a flow decrease (returning to position A).

Therefore, the circulating valve assembly 46 changes to its second configuration only in response to alternating ones of a series of flow increases. However, in other examples, the profile 84 could be configured so that the circulating valve assembly 46 changes to its second configuration in response to every third, fourth or other sequence of flow increases. In still other examples, the profile 84 could be configured so that the circulating valve assembly 46 changes to its first configuration only in response to alternating ones, or every third, fourth or other sequence of flow decreases. Thus, the scope of this disclosure is not limited to any particular shape of the profile 84, or to any particular sequence or number of flow increases or decreases required to change the circulating valve assembly 46 to its first or second configuration.

Referring additionally now to FIGS. 6A-D, the actuator 66 is depicted in various operational configurations corresponding to the respective positions A-D of the follower 82 relative to the profile 84 of the ratchet device 70 of FIG. 5. However, other operational configurations may be used in keeping with the scope of this disclosure.

Figure 6A:
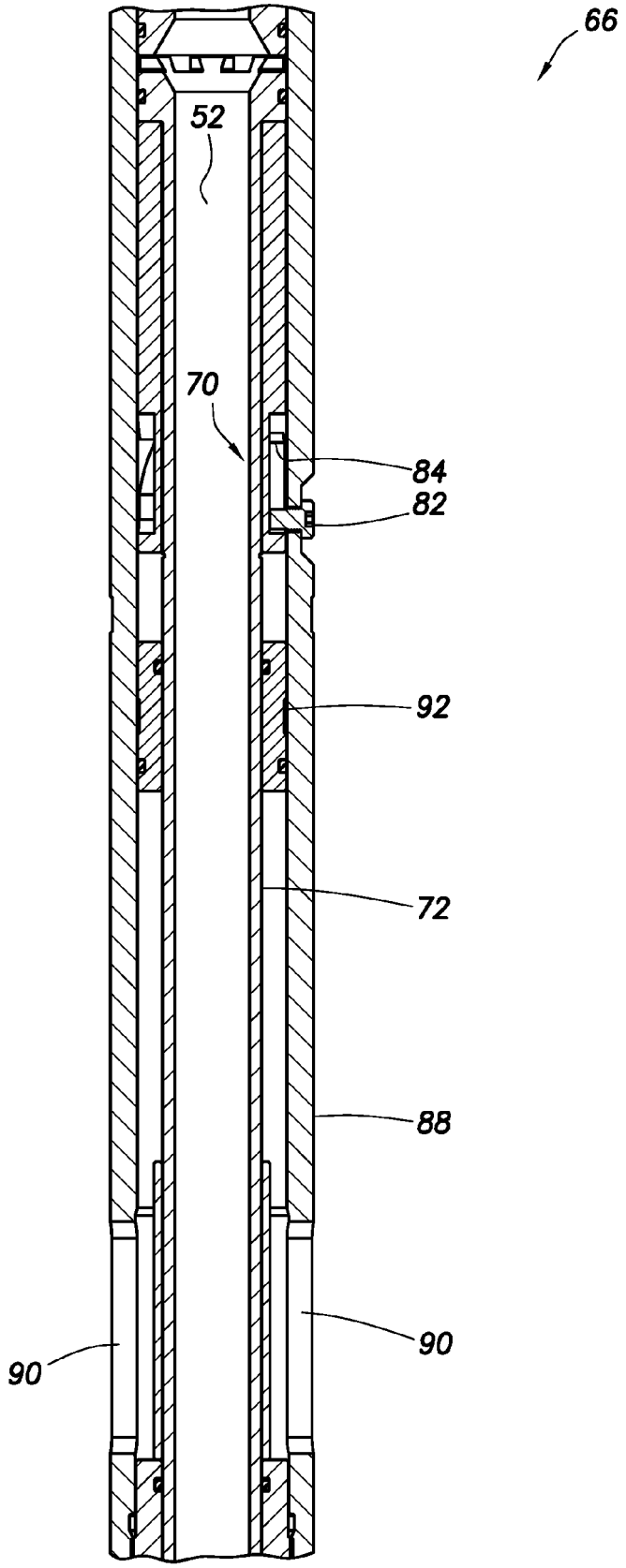
FIGS. 6A-D are representative cross-sectional views of an actuator of the circulating valve assembly in various operational configurations.

In FIG. 6A, the circulating valve assembly 46 is in its first configuration (with the valve 56 closed and the valve 58 open), and the follower 82 is at position A in the profile 84. Note that the mandrel 72 is at its most upward position relative to the outer housing 88.

Figure 6B:
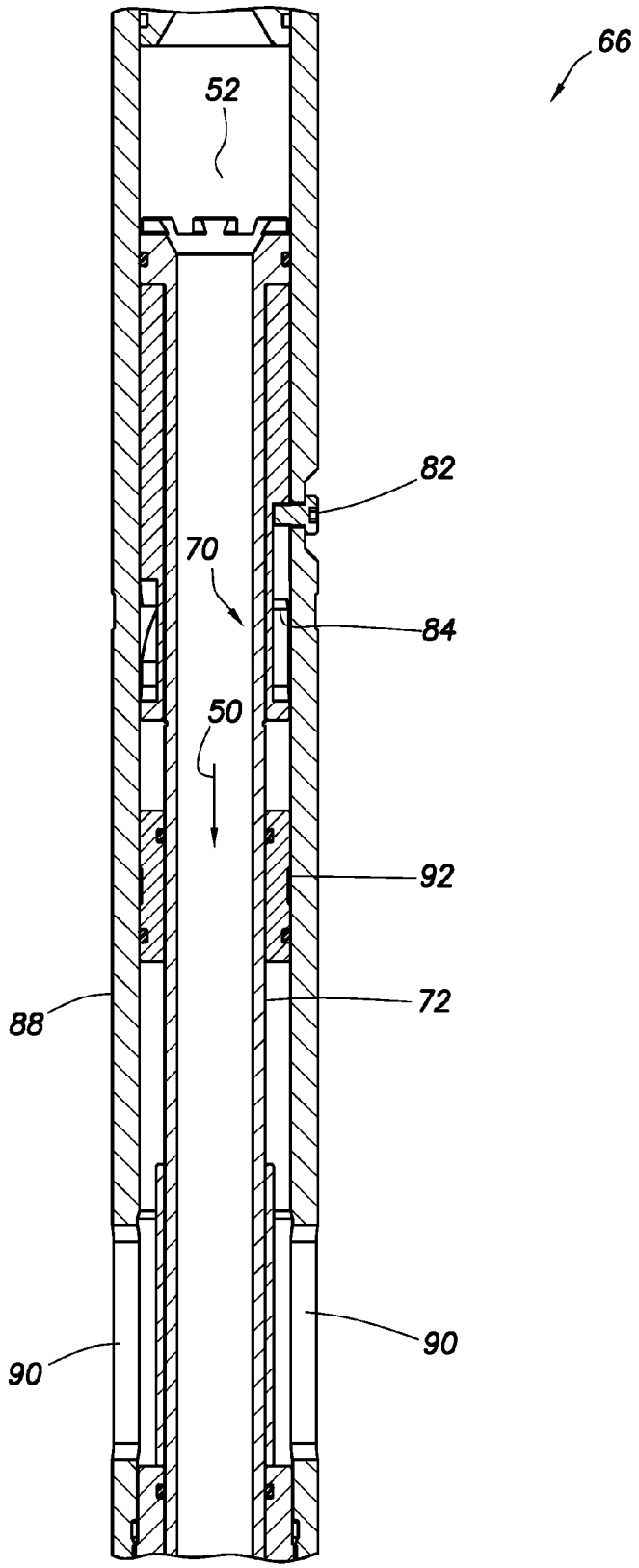

In FIG. 6B, flow through the passage 52 has increased, and the pressure differential from the interior to the exterior of the circulating valve assembly 46 has increased, so that the mandrel 72 and sleeve 86 are displaced downward relative to the outer housing 88, and the follower 82 is at position B in the profile 84. The circulating valve assembly 46, however, remains in its first configuration.

Figure 6C:
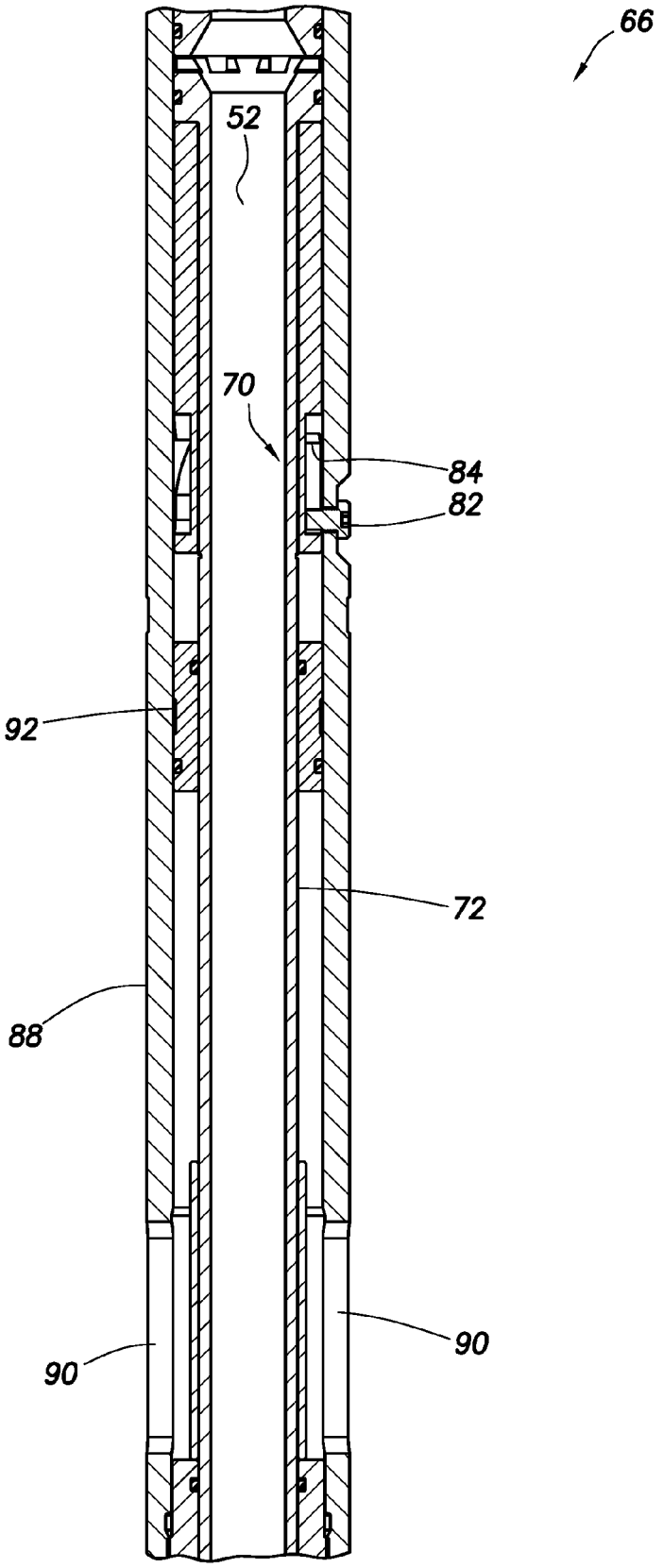

In FIG. 6C, flow through the passage 52 has decreased, and the pressure differential from the interior to the exterior of the circulating valve assembly 46 has decreased, so that the mandrel 72 and sleeve 86 are displaced back upward to their FIG. 6A position relative to the outer housing 88, and the follower 82 is at position C in the profile 84. The circulating valve assembly 46 remains in this first configuration.

Figure 6D:
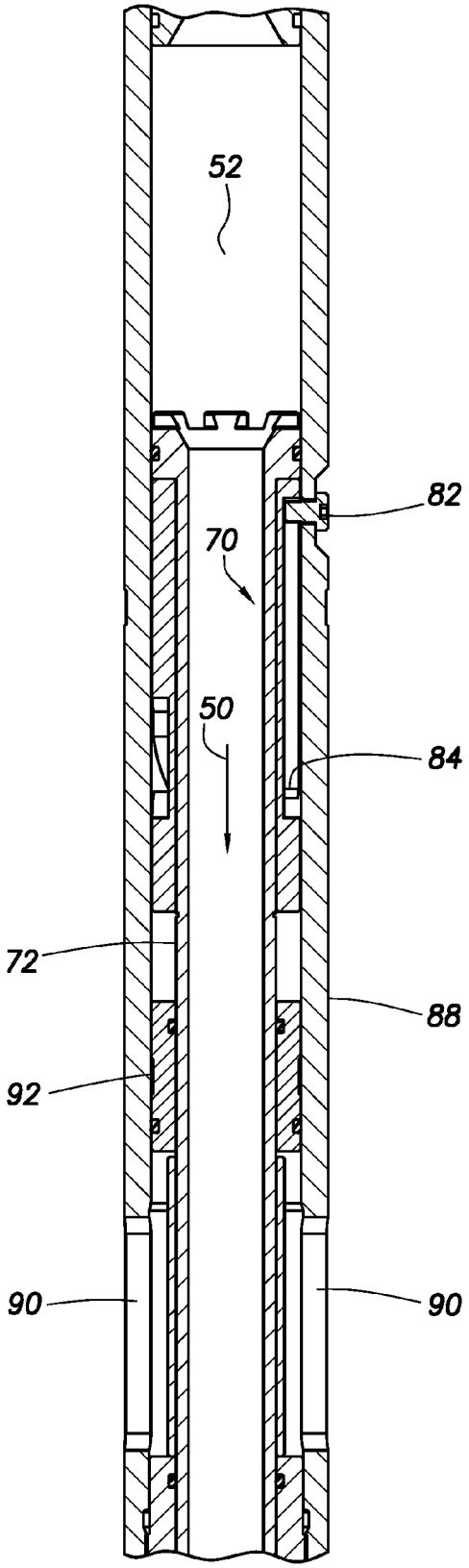

In FIG. 6D, flow through the passage 52 has increased, and the pressure differential from the interior to the exterior of the circulating valve assembly 46 has increased, so that the mandrel 72 and sleeve 86 are displaced downward relative to the outer housing 88, and the follower 82 is at position D in the profile 84. The circulating valve assembly 46 is, thus, changed to its second configuration (with the valve 56 open and the valve 58 closed). A subsequent sufficient decrease in flow can return the circulating valve assembly 46 to its first configuration.

Referring additionally now to FIGS. 7A-D, the valve 56 is depicted in various operational configurations corresponding to the respective positions A-D of the follower 82 relative to the profile 84 of the ratchet device 70 of FIG. 5. However, other operational configurations may be used in keeping with the scope of this disclosure.

The valve 56 is of the type known to those skilled in the art as a "sliding sleeve" valve, with the mandrel 78 serving as the sliding sleeve in this example. The valve 56 is closed when the mandrel 78 blocks flow through the port 94, and the valve is open when ports 96 in the mandrel are in fluid communication with the port 94. However, the scope of this disclosure is not limited to any particular type of valve.

Figure 7A:
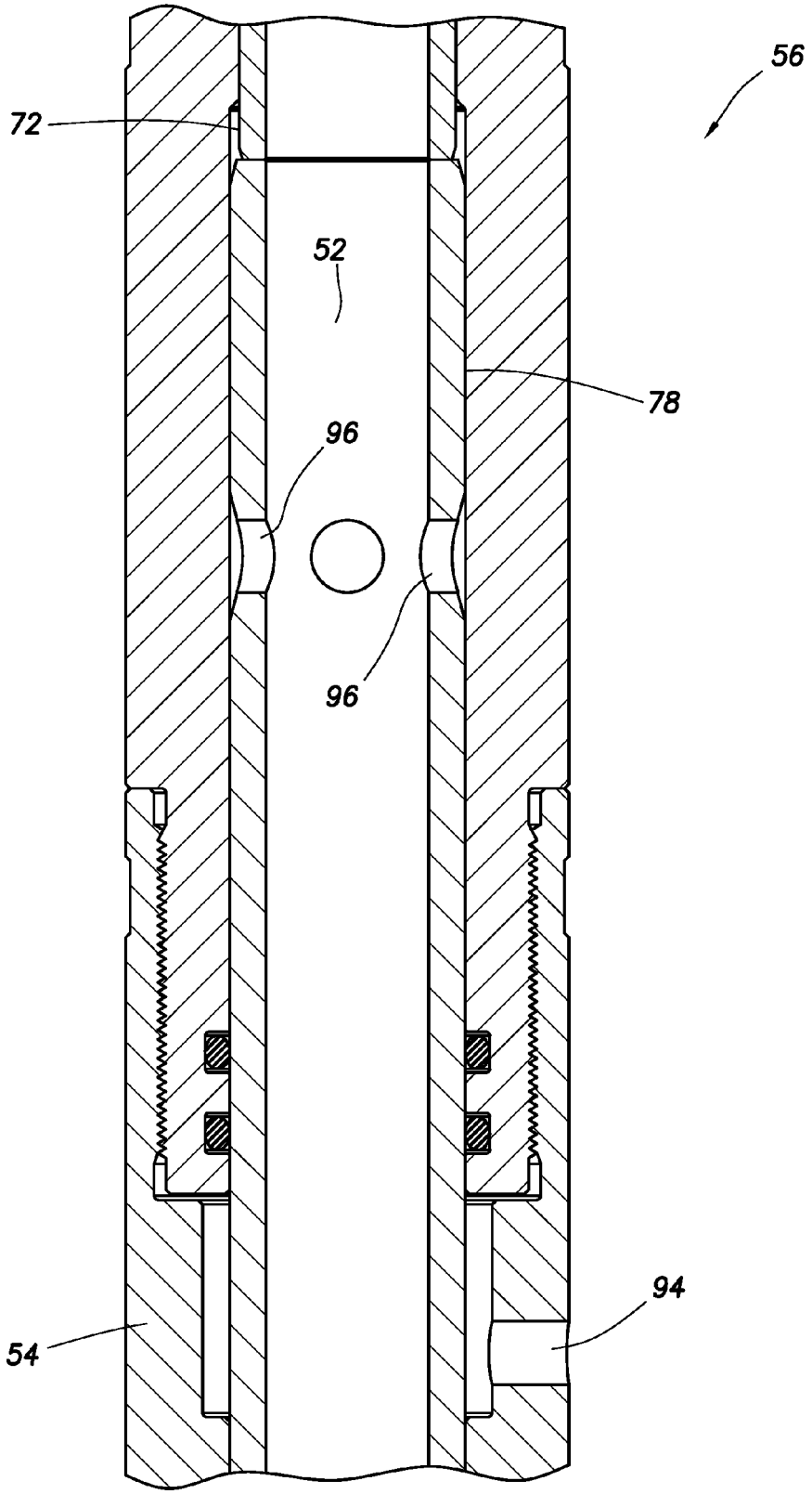
FIGS. 7A-D are representative cross-sectional views of a valve of the circulating valve assembly in various operational configurations.

In FIG. 7A, the circulating valve assembly 46 is in its first configuration (with the valve 56 closed and the valve 58 open), and the follower 82 is at position A in the profile 84. The mandrel 78 blocks flow through the port 94.

Figure 7B:
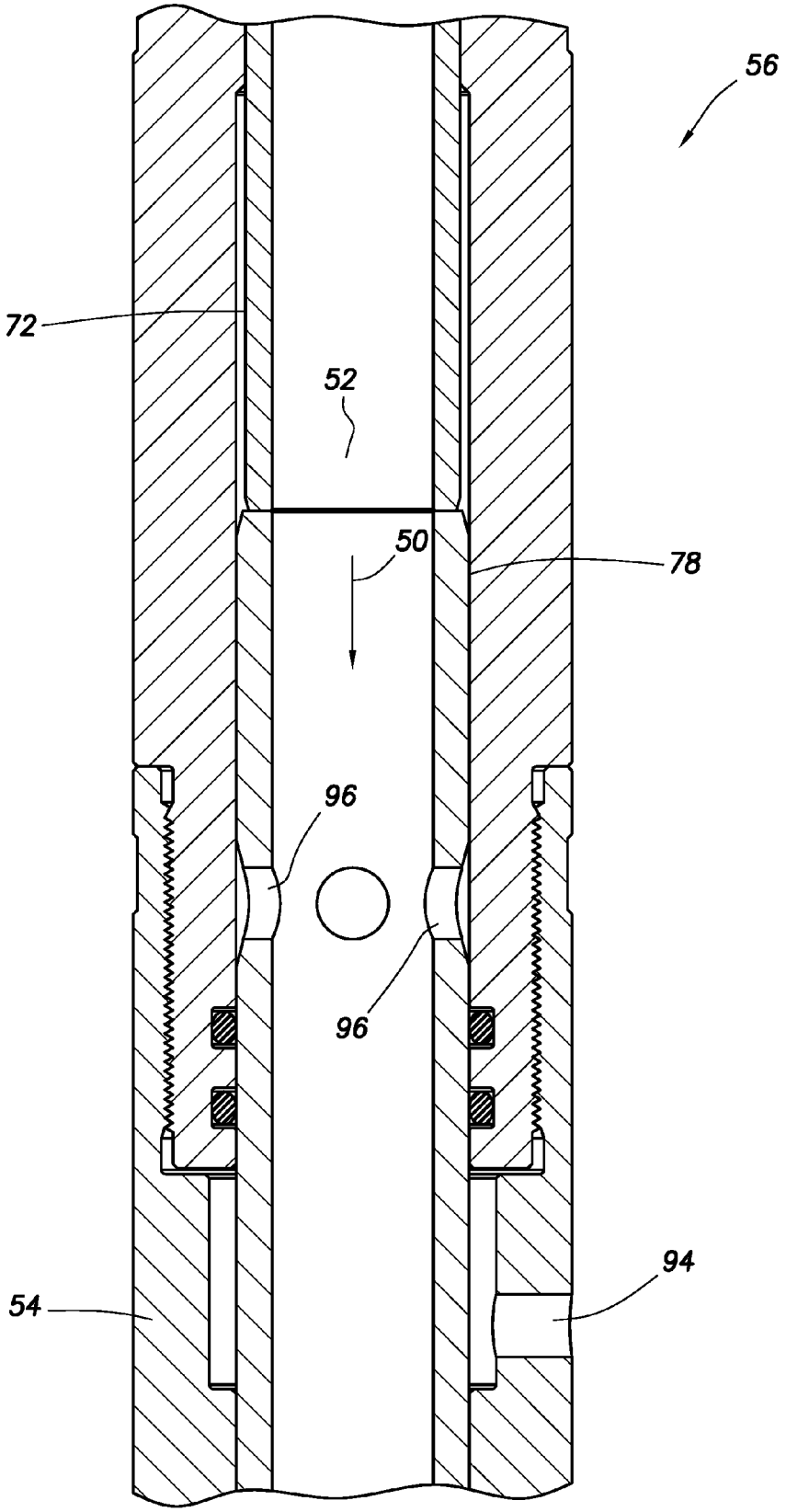

In FIG. 7B, flow through the passage 52 has increased, and the pressure differential from the interior to the exterior of the circulating valve assembly 46 has increased, so that the mandrel 78 is displaced downward, and the follower 82 is at position B in the profile 84. However, the mandrel 78 still blocks flow through the port 94.

Figure 7C:
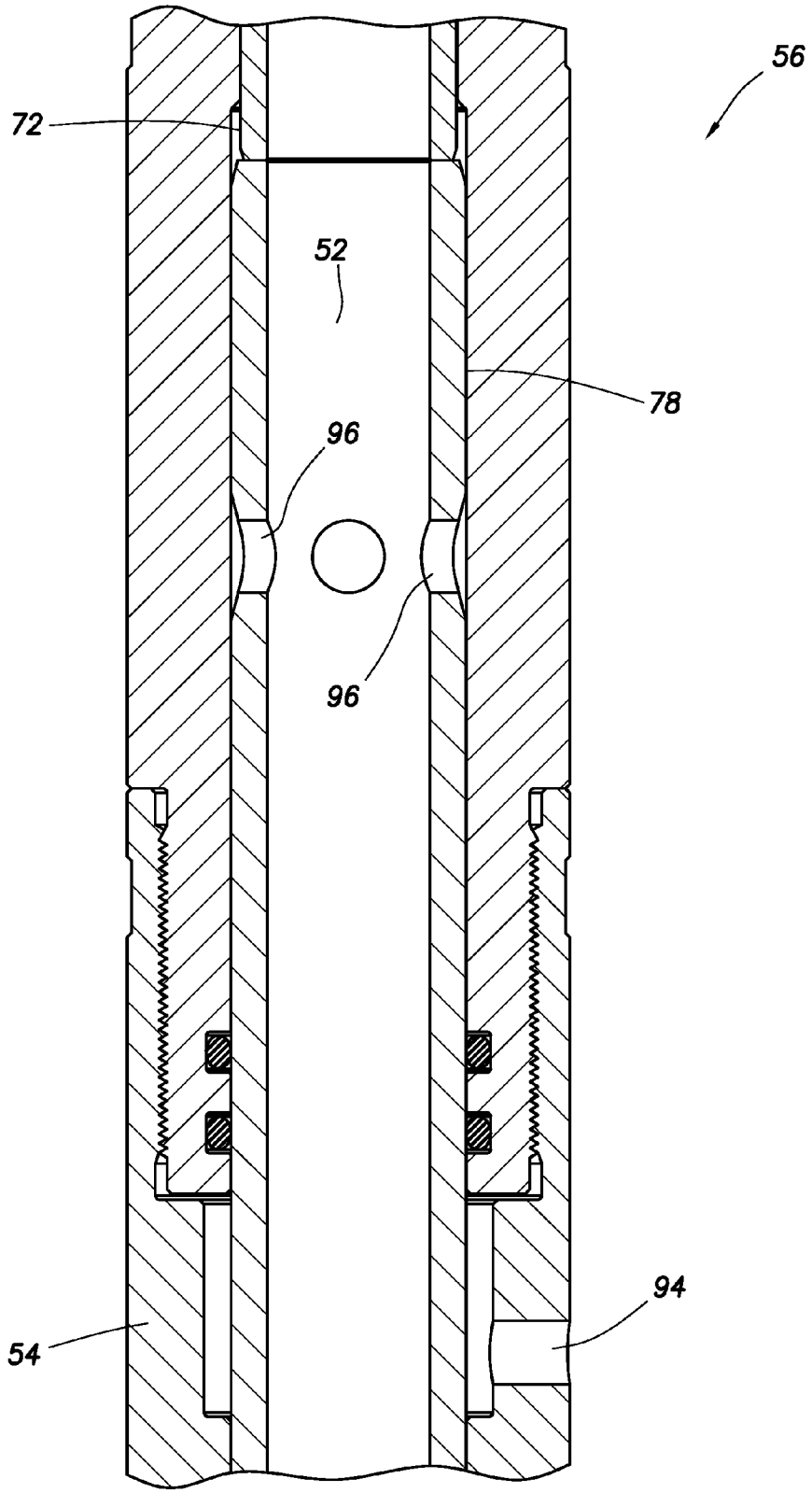

In FIG. 7C, flow through the passage 52 has decreased, and the pressure differential from the interior to the exterior of the circulating valve assembly 46 has decreased, so that the mandrel 78 is displaced back upward to its FIG. 7A position, and the follower 82 is at position C in the profile 84. The circulating valve assembly 46 remains in its first configuration, with the mandrel 78 blocking flow through the port 94.

Figure 7D:
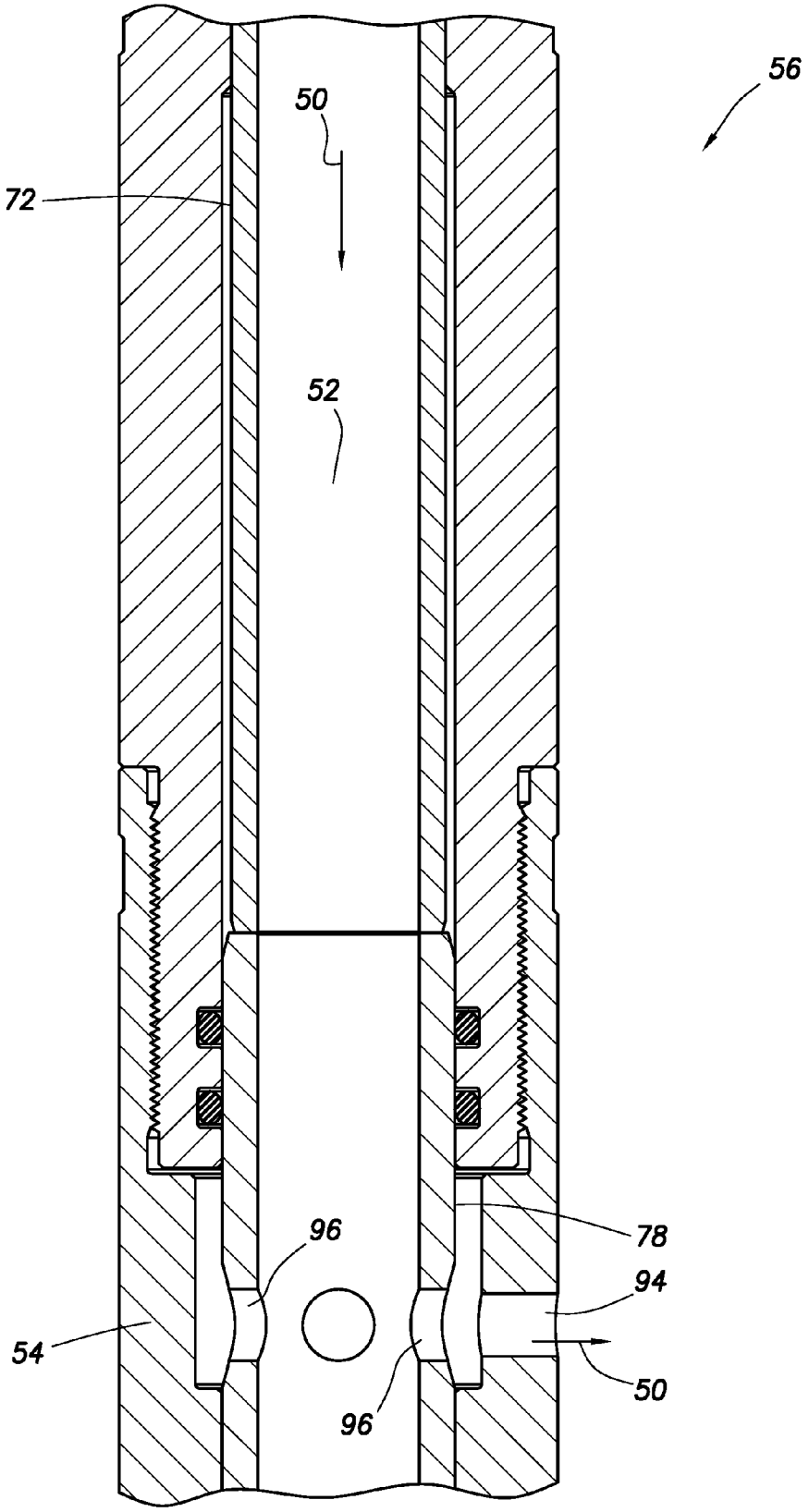

In FIG. 7D, flow through the passage 52 has increased, and the pressure differential from the interior to the exterior of the circulating valve assembly 46 has increased, so that the mandrel 78 is displaced downward, and the follower 82 is at position D in the profile 84. The circulating valve assembly 46 is, thus, changed to its second configuration, with flow being permitted through the port 94. A subsequent sufficient decrease in flow can return the circulating valve assembly 46 to its first configuration.

Referring additionally now to FIGS. 8A-D, the valve 58 is depicted in various operational configurations corresponding to the respective positions A-D of the follower 82 relative to the profile 84 of the ratchet device 70 of FIG. 5. However, other operational configurations may be used in keeping with the scope of this disclosure.

In this example, the valve 58 includes an internally blocked sleeve 98 connected to a lower end of the mandrel 78. The sleeve 98 includes two sets of ports 100, 102. The ports 100 continually permit fluid communication between an upper section 52*a* of the flow passage 52 and an annulus 104 formed radially between the sleeve 98 and an outer housing 106. The sleeve 98 can be displaced to a position in which fluid communication is permitted between the annulus 104 and a lower section 52*b* of the flow passage 52, and another position in which such fluid communication is prevented.

The valve 58 is closed when the sleeve 98 is in a downward position and flow through the ports 102 is blocked, and the valve is open when the sleeve 98 is in an upward position and flow through the ports 102 is not blocked. However, the scope of this disclosure is not limited to any particular type of valve.

Figure 8A:
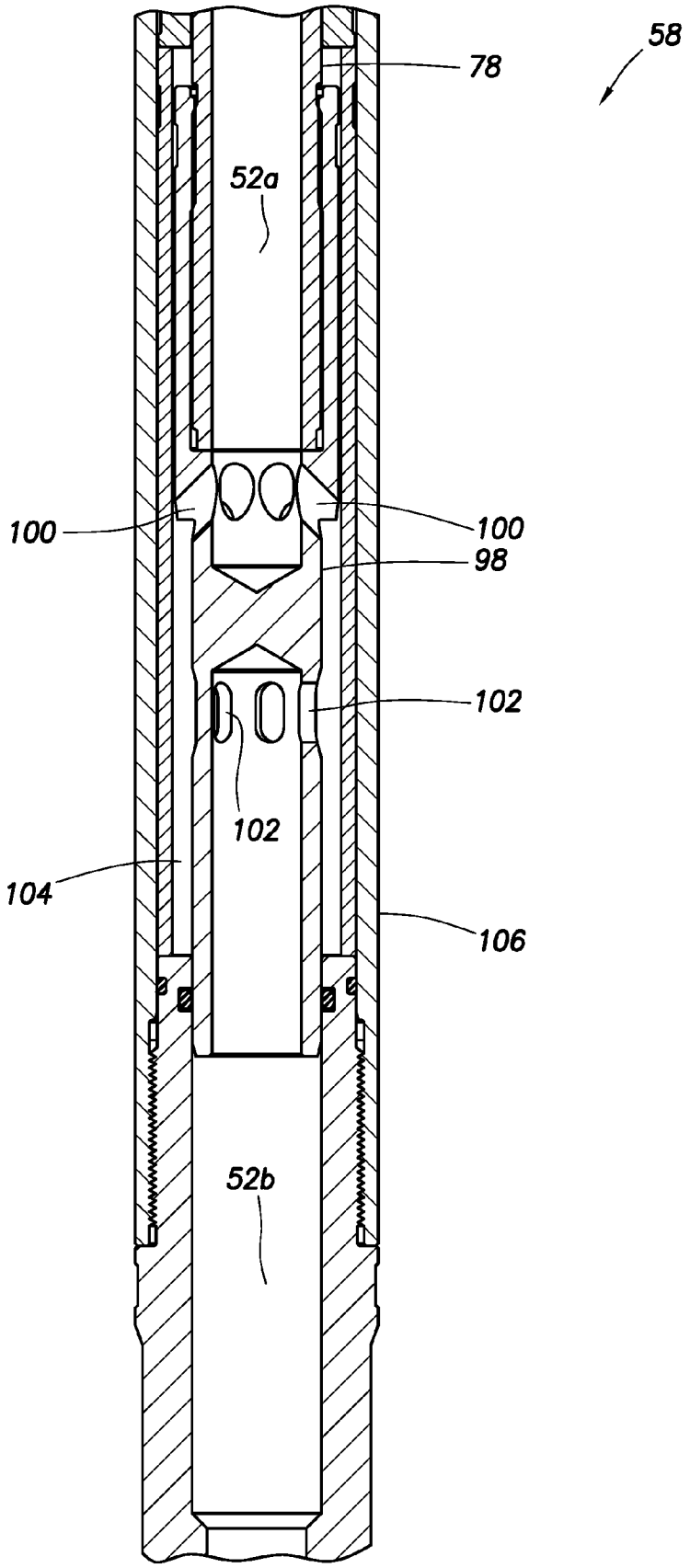
FIGS. 8A-D are representative cross-sectional views of another valve of the circulating valve assembly in various operational configurations.

In FIG. 8A, the circulating valve assembly 46 is in its first configuration (with the valve 56 closed and the valve 58 open), and the follower 82 is at position A in the profile 84. Flow between the upper and lower sections 52*a,b* of the passage 52 is permitted via the ports 102.

Figure 8B:
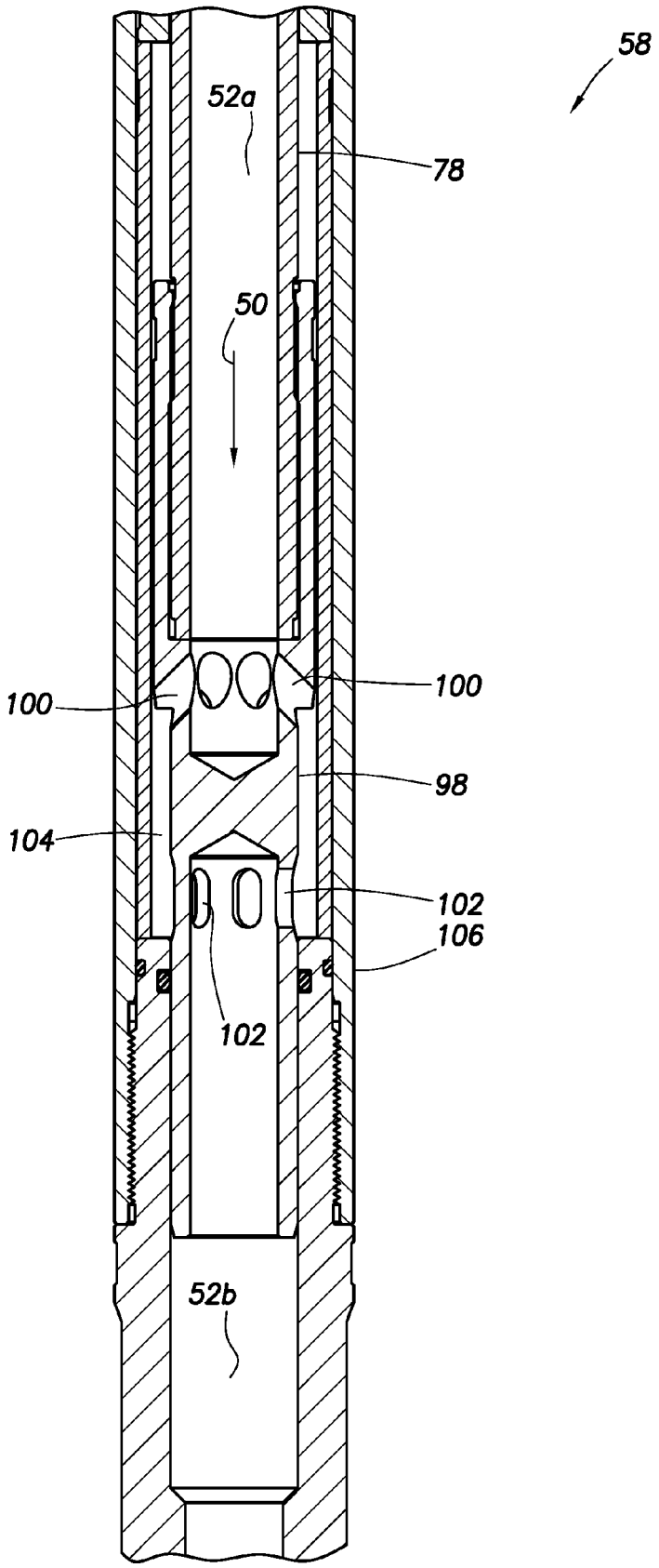

In FIG. 8B, flow through the passage 52 has increased, and the pressure differential from the interior to the exterior of the circulating valve assembly 46 has increased, so that the mandrel 78 is displaced downward, and the follower 82 is at position B in the profile 84. However, flow between the upper and lower sections 52*a,b* of the passage 52 is still permitted via the ports 102.

Figure 8C:
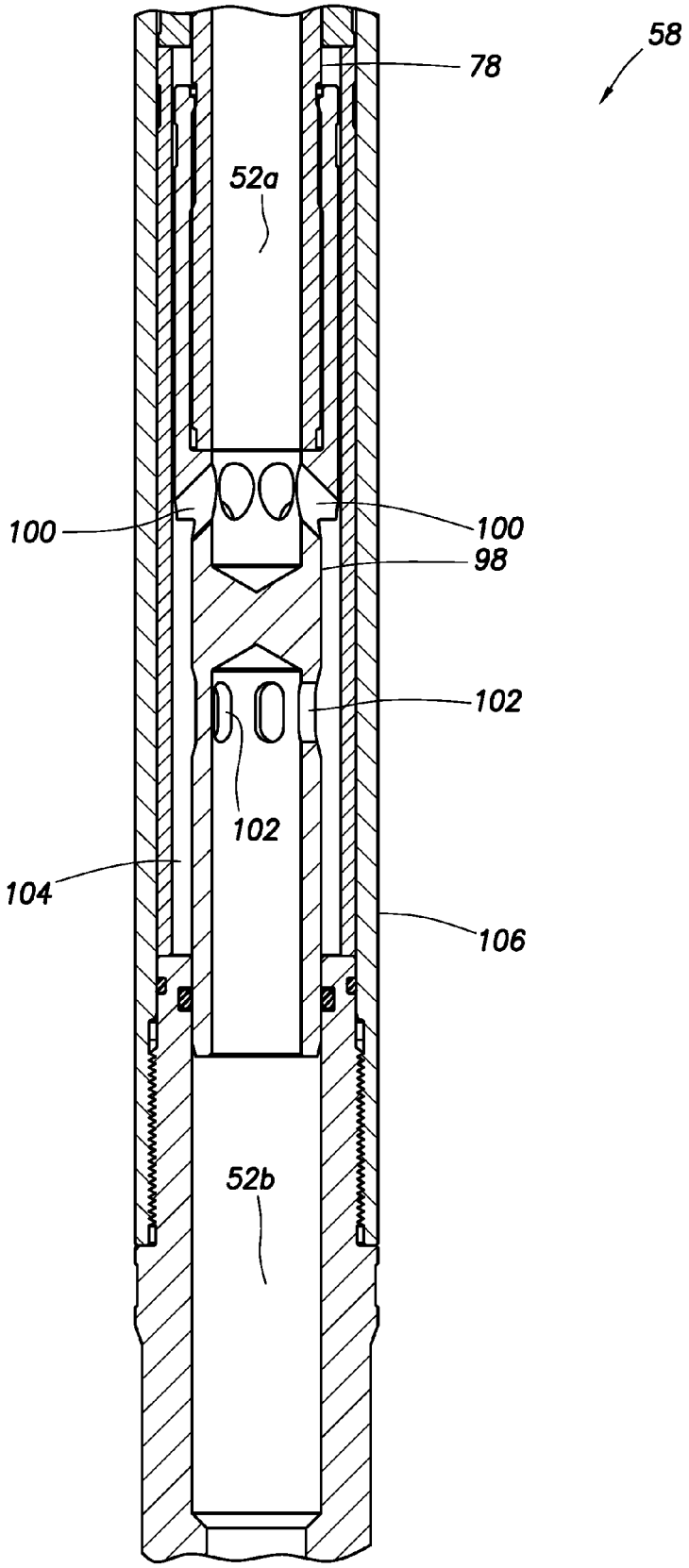

In FIG. 8C, flow through the passage 52 has decreased, and the pressure differential from the interior to the exterior of the circulating valve assembly 46 has decreased, so that the mandrel 78 is displaced back upward to its FIG. 8A position, and the follower 82 is at position C in the profile 84. The circulating valve assembly 46 remains in its first configuration, with flow being permitted between the upper and lower sections 52*a,b* of the passage 52.

Figure 8D:
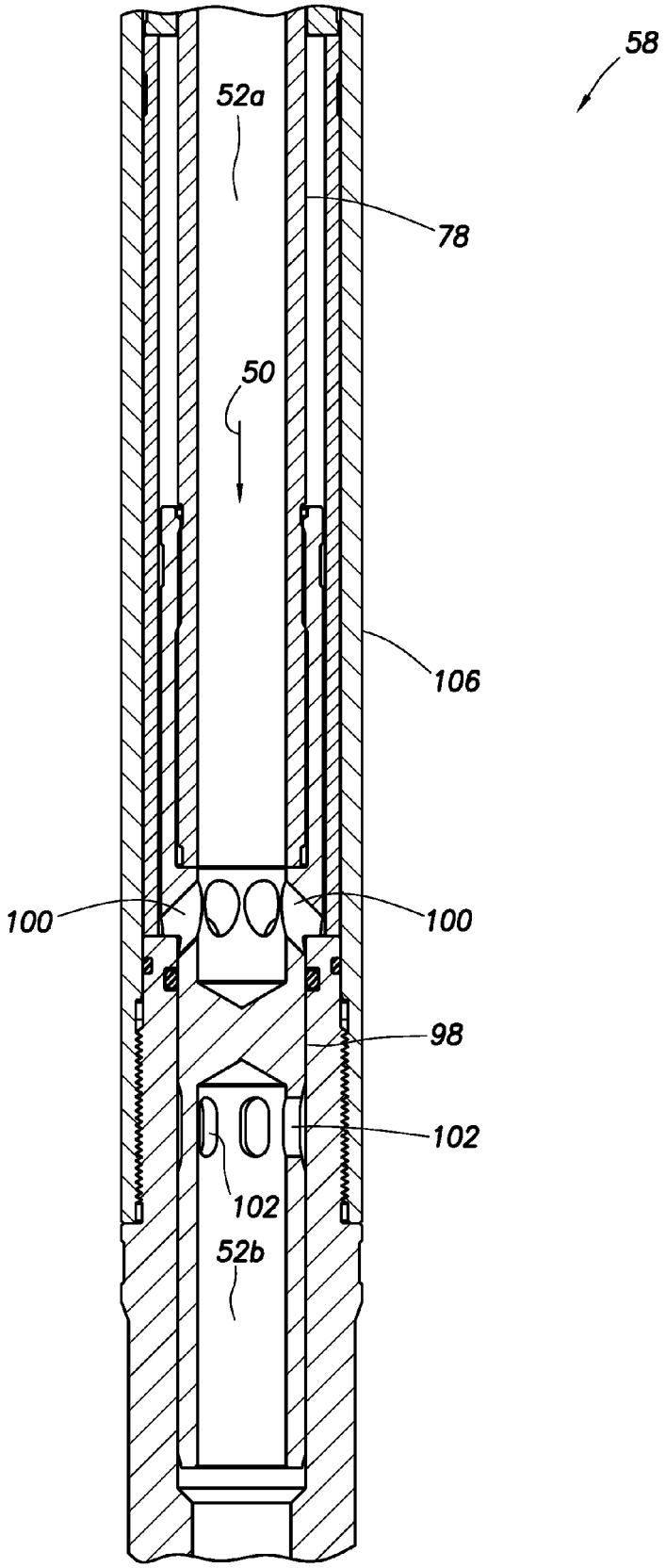

In FIG. 8D, flow through the passage 52 has increased, and the pressure differential from the interior to the exterior of the circulating valve assembly 46 has increased, so that the mandrel 78 is displaced downward, and the follower 82 is at position D in the profile 84. The circulating valve assembly 46 changes to its second configuration, with fluid communication between the upper and lower sections 52*a,b* of the passage 52 being prevented (or at least substantially restricted). A subsequent sufficient decrease in flow can return the circulating valve assembly 46 to its first configuration.

If it is desired to allow for some flow through the valve 58 in its closed position, a bypass passage may be provided so that, even though flow through the ports 102 is prevented, flow through the bypass passage is permitted. For example, an orifice (not shown) could be provided in the blocked sleeve 98, such that flow is continually permitted between the upper and lower sections 52*a,b* of the passage 52 via the orifice, although flow through the orifice would be substantially restricted. Thus, in the closed position of the valve 58, a substantial majority of the fluid 50 would flow outward through the valve 56, even though some flow would still be permitted through the orifice to the lower section 52*b* of the passage 52.

It may now be fully appreciated that the above disclosure provides significant advancements to the art of controlling fluid flow in wells. In some examples described above, the circulating valve assembly 46 can be repeatedly cycled between different configurations to provide for flow via respective different flow paths. This result can be accomplished by merely varying a rate of flow through the circulating valve assembly 46.

The above disclosure provides to the art a circulating valve assembly 46. In one example, the circulating valve assembly 46 can include a first valve 56 that controls flow through a port 94 in a sidewall 54 of the circulating valve assembly between an interior and an exterior of the circulating valve assembly, a second valve 58 that controls flow between sections 52*a,b* of a flow passage 52 extending longitudinally through the circulating valve assembly 46, and an actuator 66 that both opens the first valve 56 and closes the second valve 58 in response to each of multiple first positive pressure differentials from the interior to the exterior of the circulating valve assembly 46 (e.g., position D described above).

The circulating valve assembly 46 can also include a biasing device 68. The biasing device 68 continually biases the first valve 56 toward a closed position and continually biases the second valve 58 toward an open position.

The actuator 66 may prevent the first valve 56 from opening and prevent the second valve 58 from closing in response to each of multiple second positive pressure differentials from the interior to the exterior of the circulating valve assembly 46 (e.g., position B described above). The first and second positive pressure differentials can be alternately applied to the circulating valve assembly 46.

The actuator 66 can include a ratchet device 70. The ratchet device 70 may include a profile 84 that permits the first valve 56 to open and the second valve 58 to close in response to the first positive pressure differential (position D), but prevents the first valve 56 from opening and the second valve 58 from closing in response to a second positive pressure differential from the interior to the exterior of the circulating valve assembly 46 (position B).

The second positive pressure differential may be between two of the first positive pressure differentials. The profile 84 can comprise a "J-slot" profile.

The first valve 56 may close and the second valve 58 may open in response to a decrease in the first positive pressure differential. The first valve 56 may remain closed and the second valve 58 may remain open in response to a decrease in the second positive pressure differential.

The first valve 56 can remain open while the first positive pressure differential is maintained by flow through the port 94.

Also provided to the art by the above disclosure is a method of controlling flow through a tubular string 12 in a well. In one example, the method can comprise: alternately increasing and decreasing flow through the tubular string 12, thereby producing multiple first flow increases, multiple second flow increases and multiple flow decreases; a first valve 56 of a circulating valve assembly 46 opening in response to each of the first flow increases (position D); a second valve 58 of the circulating valve assembly 46 closing in response to each of the first flow increases; and upon each of the flow decreases (positions A & C), the first valve 56 being (including remaining) closed and the second valve 58 being (including remaining) open.

The first valve 56 may remain closed in response to each of the second flow increases (position B), and the second valve 58 may remain open in response to each of the second flow increases. The first and second flow increases (positions D & B, respectively) may be alternately applied.

Each of the first and second flow increases can produce a positive pressure differential from an interior to an exterior of the circulating valve assembly 46. Following each of the first flow increases (position D), the first valve 56 may remain open and the second valve 58 may remain closed, until the positive pressure differential decreases to a predetermined level.

The opening of the first valve 56 may permit flow from an interior to an exterior of the circulating valve assembly 46 through a port 94 in a sidewall 54 of the circulating valve assembly, and the closing of the second valve 58 may prevent flow between sections 52*a,b* of a flow passage 52 extending longitudinally through the circulating valve assembly 46.

The tubular string 12 may comprise a coiled tubing 20. A fluid motor 40 can be connected in the tubular string 12, and closing of the second valve 58 can prevent flow through the fluid motor 40. A jet perforator 60 may be connected in the tubular string 12, and closing of the second valve 58 may prevent flow through the jet perforator 60. A vibratory tool 44 can be connected in the tubular string 12, and closing of the second valve 58 can prevent flow through the vibratory tool 44.

A biasing device 68 can continually bias the first valve 56 toward a closed configuration and continually bias the second valve 58 toward an open configuration. The biasing device 68 may displace a member (such as the mandrel 72) of the first valve 56 toward a closed position and displace a member (such as the sleeve 98) of the second valve 58 toward an open position, in response to each of the flow decreases (positions A & C).

A system 10 for use with a well is also described above. In one example, the system 10 can include a circulating valve assembly 46 that controls flow through a tubular string 12 and at least one well tool (such as, the bit 38, the fluid motor 40, the stabilizer 42, the vibratory tool 44 and/or the perforator 60) connected in the tubular string 12 downstream of the circulating valve assembly 46. In a first configuration of the circulating valve assembly 46, the flow passes through the well tool. In a second configuration of the circulating valve assembly 46, the flow passes from the tubular string 12 to an annulus 30 external to the tubular string, and the flow substantially bypasses the well tool. The circulating valve assembly 46 cycles between the first and second configurations in response to alternating increases and decreases in the flow.

The flow may not entirely bypass the well tool, in that a small amount of the flow may be permitted to pass through the well tool in the second configuration. in an example described above, an orifice or bypass passage could be provided in the valve 58 to allow the small amount of flow through the well tool in the second configuration. However, a substantial majority of the flow will bypass the well tool (not flow through the well tool to the annulus 30) in the second configuration.

In the first configuration, the flow may be prevented from passing from the tubular string 12 to the annulus 30 through a sidewall 54 of the circulating valve assembly 46.

The tubular string 12 can comprise a coiled tubing 20, and the well tool can comprise a fluid motor 40, a vibratory tool 44, and/or a jet perforator 60.

The circulating valve assembly 46 may comprise first and second valves 56, 58, the first valve being closed and the second valve being open in the first configuration, and the first valve being open and the second valve being closed in the second configuration. The circulating valve assembly 46 can be actuated to the second configuration in response to alternating ones of the flow increases.

Following alternating ones of the flow increases, the circulating valve assembly 46 may remain in the second configuration until the flow decreases to a predetermined level. The circulating valve assembly 46 can be in the first configuration whenever there is an absence of the flow.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A circulating valve assembly, comprising:

a first valve that controls flow through a port in a sidewall of the circulating valve assembly between an interior and an exterior of the circulating valve assembly;

a second valve that controls flow between sections of a flow passage extending longitudinally through the circulating valve assembly; and an actuator that both opens the first valve and closes the second valve in response to every other positive pressure differential applied from the interior to the exterior of the circulating valve assembly.

2. The circulating valve assembly of claim 1, further comprising a biasing device, and wherein the biasing device continually biases the first valve toward a closed position and continually biases the second valve toward an open position.

3. The circulating valve assembly of claim 1, wherein the actuator prevents the first valve from opening and prevents the second valve from closing in response to each intervening positive pressure differential applied from the interior to the exterior of the circulating valve assembly.

4. The circulating valve assembly of claim 1, wherein the actuator includes a ratchet device, and wherein the ratchet device includes a profile that permits the first valve to open and the second valve to close in response to the every other positive pressure differential, but prevents the first valve from opening and the second valve from closing in response to each intervening positive pressure differential from the interior to the exterior of the circulating valve assembly.

5. The circulating valve assembly of claim 4, wherein the profile comprises a "J-slot" profile.

6. The circulating valve assembly of claim 4, wherein the first valve closes and the second valve opens in response to a decrease in the every other positive pressure differential.

7. The circulating valve assembly of claim 4, wherein the first valve remains closed and the second valve remains open in response to a decrease in the intervening positive pressure differential.

8. The circulating valve assembly of claim 1, wherein the first valve remains open while the every other positive pressure differential is maintained by flow through the port.

9. A method of controlling flow through a tubular string in a well, the method comprising:

alternately increasing and decreasing flow through the tubular string, thereby producing multiple flow increases and multiple flow decreases;

a first valve of a circulating valve assembly opening in response to every other flow increase;

a second valve of the circulating valve assembly closing in response to the every other flow increase; and upon each of the flow decreases, the first valve being closed and the second valve being open.

10. The method of claim 9, wherein the first valve remains closed and the second valve remains open in response to each intervening flow increase.

11. The method of claim 9, wherein each of the multiple flow increases produces a positive pressure differential from an interior to an exterior of the circulating valve assembly.

12. The method of claim 11, wherein, following the every other flow increase, the first valve remains open and the second valve remains closed, until the positive pressure differential decreases to a predetermined level.

13. The method of claim 9, wherein the opening of the first valve permits flow from an interior to an exterior of the circulating valve assembly through a port in a sidewall of the circulating valve assembly, and wherein the closing of the second valve prevents flow between sections of a flow passage extending longitudinally through the circulating valve assembly.

14. The method of claim 9, wherein a fluid motor is connected in the tubular string, and wherein closing of the second valve prevents flow through the fluid motor.

15. The method of claim 9, wherein a jet perforator is connected in the tubular string, and wherein closing of the second valve prevents flow through the jet perforator.

16. The method of claim 9, wherein a vibratory tool is connected in the tubular string, and wherein closing of the second valve prevents flow through the vibratory tool.

17. The method of claim 9, wherein the tubular string comprises a coiled tubing.

18. The method of claim 9, wherein a biasing device continually biases the first valve toward a closed configuration and continually biases the second valve toward an open configuration.

19. The method of claim 18, wherein the biasing device displaces a member of the first valve toward a closed position and displaces a member of the second valve toward an open position, in response to each of the flow decreases.

20. A system for use with a well, the system comprising:

a circulating valve assembly that controls flow through a tubular string and at least one well tool connected in the tubular string downstream of the circulating valve assembly;

in a first configuration of the circulating valve assembly, the flow passes through the well tool;

in a second configuration of the circulating valve assembly, the flow passes from the tubular string to an annulus external to the tubular string, and the flow substantially bypasses the well tool;

wherein the circulating valve assembly comprises first and second valves, the first valve being closed and the second valve being open in the first configuration, and the first valve being open and the second valve being closed in the second configuration, and wherein the circulating valve assembly cycles from the first configuration to the second configuration in response to every other increase in the flow.

21. The system of claim 20, wherein the flow is prevented from passing from the tubular string to the annulus through a sidewall of the circulating valve assembly, in the first configuration.

22. The system of claim 20, wherein the tubular string comprises a coiled tubing, and wherein the well tool comprises a fluid motor.

23. The system of claim 20, wherein the tubular string comprises a coiled tubing, and wherein the well tool comprises a vibratory tool.

24. The system of claim 20, wherein the tubular string comprises a coiled tubing, and wherein the well tool comprises a jet perforator.

25. The system of claim 20, wherein, following the every other increase in the flow, the circulating valve assembly remains in the second configuration until the flow decreases to a predetermined level.

26. The system of claim 25, wherein the circulating valve assembly is in the first configuration whenever the flow is below the predetermined level.

* * * * *